US005818405A

United States Patent [19]

Eglit et al.

[11] Patent Number: 5,818,405

[45] Date of Patent: Oct. 6, 1998

[54] METHOD AND APPARATUS FOR REDUCING FLICKER IN SHADED DISPLAYS

[75] Inventors: Alexander Julian Eglit, Half Moon Bay; Robin Sungsoo Han, Saratoga, both of Calif.

[73] Assignee: Cirrus Logic, Inc., Fremont, Calif.

[21] Appl. No.: 555,991

[22] Filed: Nov. 15, 1995

[51] Int. Cl.[6] ..... G09G 3/36

[52] U.S. Cl. ..... 345/88; 345/89; 345/150; 345/199; 345/147

[58] Field of Search ..... 345/87, 88, 89, 345/98, 100, 147, 148, 149, 150, 153, 154, 155, 199

[56] References Cited

U.S. PATENT DOCUMENTS

| | | | |
|---|---|---|---|
| 5,117,298 | 5/1992 | Hirai | 359/55 |
| 5,122,783 | 6/1992 | Bassetti | 340/701 |
| 5,196,839 | 3/1993 | Johary et al. | 340/793 |
| 5,253,091 | 10/1993 | Kimura et al. | 359/55 |
| 5,283,651 | 2/1994 | Ishizuka | 348/704 |
| 5,313,224 | 5/1994 | Singhal et al. | 345/89 |
| 5,389,948 | 2/1995 | Liu | 345/147 |
| 5,402,141 | 3/1995 | Haim et al. | 345/88 |
| 5,404,235 | 4/1995 | Okada | 359/54 |
| 5,416,514 | 5/1995 | Janssen et al. | 348/196 |
| 5,420,604 | 5/1995 | Scheffer et al. | 345/100 |
| 5,420,608 | 5/1995 | Choi et al. | 345/186 |
| 5,430,458 | 7/1995 | Weber | 345/60 |
| 5,436,747 | 7/1995 | Suzuki | 359/55 |

FOREIGN PATENT DOCUMENTS 07160217 6/1995 Japan .

OTHER PUBLICATIONS

Liquid Crystal Display Gray Scale Method Using a Pseudo-–Linear Algorithm, IBM Technical Disclosure Bulletin, vol. 35, No. 7, pp. 173–182, IBM Corporation, Dec. 1992.

*Primary Examiner*—Xiao Wu
*Attorney, Agent, or Firm*—Robert P. Bell; Steven A. Shaw

[57] ABSTRACT

An apparatus for controlling a flat panel display with reduced flicker, particularly during grey scale shading. Three shading pattern lookup tables are provided, one for each sub-pixel color (Red, Blue, Green). Each shading pattern lookup table outputs a plurality of shading pattern duty cycle signals, each representing a different shade level. The phase of the three duty cycle signal patterns may be altered by adding a predetermined offset amount to one or more of the shading pattern lookup table addresses. By altering the phases of the outputs of the shading lookup tables, peak current demand within the flat panel display may be reduced and flicker or strobing of individual pixels may be reduced or eliminated.

23 Claims, 4 Drawing Sheets

METHOD AND APPARATUS FOR REDUCING FLICKER IN SHADED DISPLAYS

FIELD OF THE INVENTION

The present invention relates to an apparatus and method for reducing flicker effects in shaded displays, particularly passive matrix monochrome and color flat panel displays such as a dual scan super-twist nematic (DSTN) display panel.

BACKGROUND OF THE INVENTION

Flat panels displays are known for use with computer systems, particularly laptop or portable computers and the like. Such flat panel displays may also be applied to other types of devices such as televisions or television monitors, industrial and automotive controls and the like.

Flat panel displays may comprise a matrix of binary pixel elements. For example, in popular LCD (liquid crystal display) panel displays, a matrix of passive or active LCD pixels may be used to generate a display. For color LCD displays, a matrix of red, blue and green LCD sub-pixels may be provided. Regardless of whether the display is active matrix or passive matrix, each LCD pixel or sub-pixel within such a display generally has one of two states; on or off.

In order to achieve levels of grey scaling or various color intensities, methods of temporal cycling or spatial dithering may be employed. Such frame rate modulation and dithering techniques are described in Bassetti, Jr., U.S. Pat. No. 5,122,783, issued Jun. 16, 1992, assigned to the same assignee as the present application and incorporated herein by reference. Shading techniques are also described in published PCT application Ser. No. WO 93/20549, published Oct. 14, 1994, entitled "Process for Producing Shaded Color Images on Display Screens", also incorporated herein by reference.

Shading effects may be achieved using the persistence of vision phenomenon of the human eye, as well as the physical properties of a flat panel display itself. Thus, for example, to generate a pixel having a brightness of 50% of full scale, such a pixel may be cycled on and off in a 50% duty cycle. Other levels of shading or grey scaling may be achieved using corresponding duty cycles. In order to reduce flicker, adjacent pixels may be cycled in different patterns.

FIG. 1 is a block diagram illustrating grey scaling circuitry in a flat panel display controller IC. Pattern look up table (LUT) 104 may comprise, for example, a RAM or ROM containing a number of preassigned grey scaling patterns. Such grey scaling patterns may each represent a pulse train waveform which, when used to drive Red, Blue, and Green sub-pixels, create an apparent level of shading or grey scaling. Pattern LUT 104 may be supplied with signals from frame counter 101, line counter 102 and pixel counter 103, which, when combined, form an address for pattern LUT 104.

Frame counter 101 may comprise a four bit modulo 16 adder (for 17 grey scale levels) used to count successive frames of video. In general, frame counter 101 may count from 0 to N−1 where N is the number of grey scale levels. The four bit output of frame counter 101 serves as the most significant bits (MSB) of an address for pattern LUT 17. LUT 17 may then output a number of pixel pattern data. Pattern LUT 104 may output 17 bits of data, each representing a portion of a pattern duty cycle for one of 17 levels of grey scaling. Of course, other numbers of levels of grey scaling may be utilized as is known in the art.

The remaining bits of the address for pattern LUT 17 may be generated by line counter 102 and pixel counter 103. Line counter 102 and pixel counter 103 may each output three bits of data when sampling a pixel pattern of 8 by 8 pixels, or may each output four bits of data when sampling a pixel pattern of 16 by 16 pixels. The address portions provided by line counter 102 and pixel counter 103 are provided such that adjacent pixels will be cycled according to different patterns from pattern LUT 104. Thus, for example, if a LCD panel display is to display an entire 600 by 800 screen of 25% shaded pixels, all of the pixels will not cycle according to the same duty cycle, thus avoiding any flicker or stroboscopic effect.

Shade selectors 105, 106, and 107 select data values for red blue, and green sub-pixels, respectively from one of the seventeen shading values received from pattern LUT 104 based upon sub-pixel data Rin, Bin, or Gin, respectively. Sub-pixel data Rin, Bin, or Gin may comprise, for example, six-bit pixel data (at 18 bit per pixel color depth), each of the six-bit pixel data representing a color intensity for a particular pixel. Generation of Rin, Bin, and Gin values is well known in the display controller art.

Each of shade selectors 105, 106, and 107 may then output a binary (0 or 1) value representing a red, blue and green sub-pixel signal, respectively, for a particular frame, to panel interface 108. Panel interface 108 may then output signals to a flat panel display to generate a display image.

One difficulty may be encountered when particularly when displaying grey scale values in a color DSTN flat panel display. In the prior art, each of a group of red, blue and green sub-pixels may be driven according to a predetermined duty cycle or pattern, as illustrated in FIGS. 2B, 2C, and 2D. FIGS. 2B, 2C, and is a waveform diagram illustrating duty cycles for red, blue, and green sub-pixels using prior art shading techniques. As illustrated in FIGS. 2B, 2C, and 2D each of a particular Red, Blue, and Green sub-pixels for a particular pixel may be driven according to a particular duty cycle in order to generate a grey scale shade.

The 50% duty cycle shown is for purposes of illustration only. Other types of duty cycles or even irregular patterns may be utilized in order to provide various levels of grey scale shading. However, regardless of duty cycle or pattern, prior art shading techniques may synchronize these duty cycles or patterns in a manner similar to that illustrated in FIGS. 2A–2D.

One difficulty with the shading technique of FIGS. 2A–2D lies in the quality and construction of the flat panel display driven by the graphics controller. In particular, in some less expensive flat panel displays, bias voltage drivers and current supplies to rows or columns of pixels may become overloaded or saturated when all three sub-pixels being driven at the same time. In FIGS. 2A, current to the three sub-pixels is represented by waveform I.

As illustrated in FIGS. 2A–2D, current I peaks when all three sub-pixels are driven simultaneously. If the current source(s) within a flat panel display cannot provide adequate current to the sub-pixels, the temporal shading pattern may be altered and a flickering effect may be noticeable. Moreover, if all three sub-pixels (Reg, Blue, Green) are driven simultaneously, flicker or strobing of a pixel may be more noticeable.

More expensive flat panel displays, employing more power current sources and higher quality components, may alleviate flickering to some extent. However, the increased cost of such displays may make the overall computer system economically uncompetitive. Moreover, a display controller manufacturer may be required to support a number of types of flat panel displays with a particular controller product without noticeable flickering effects in the less expensive panel displays. In addition, such flickering effects may becomes much more noticeable in flat panel displays having larger numbers of pixels (e.g, 768 by 124) due to the increased length in column and row driver lines.

SUMMARY OF THE INVENTION

The shading controller of the present invention comprises a plurality of pattern look up tables, one provided for each color sub-pixel (Red, Blue, Green). Each of the pattern look up tables is coupled to line counter and pixel counter outputs to generate a first portion of an address for each pattern look up table. A frame counter is coupled to one of the pattern look up tables to provide a frame count as a second portion of a pattern look up table address for the one of the pattern look up tables. An adder, coupled to the frame counter and at least another of the pattern look up tables to add an offset value to the frame count. The sum of the frame count and offset value may be provided to at least another of the pattern look up tables as a second portion of a pattern look up table address for the at least another pattern look up table.

Each pattern look up table outputs a plurality of data values representing a portion of a shading duty cycle for a plurality of shading values. Each of the plurality of pattern look up tables is coupled to a corresponding shade selector each corresponding to a color sub-pixel. Each shade selector selects from the plurality of data values a data value corresponding to a shading duty cycle for a desired shade for a corresponding color sub-pixel.

The use of the offset value added to the frame count alters the phasing of a shading duty cycle for each color sub-pixel, reducing or eliminating flicker, particularly when grey scaling.

DETAILED DESCRIPTION OF THE INVENTION

Figure 3:
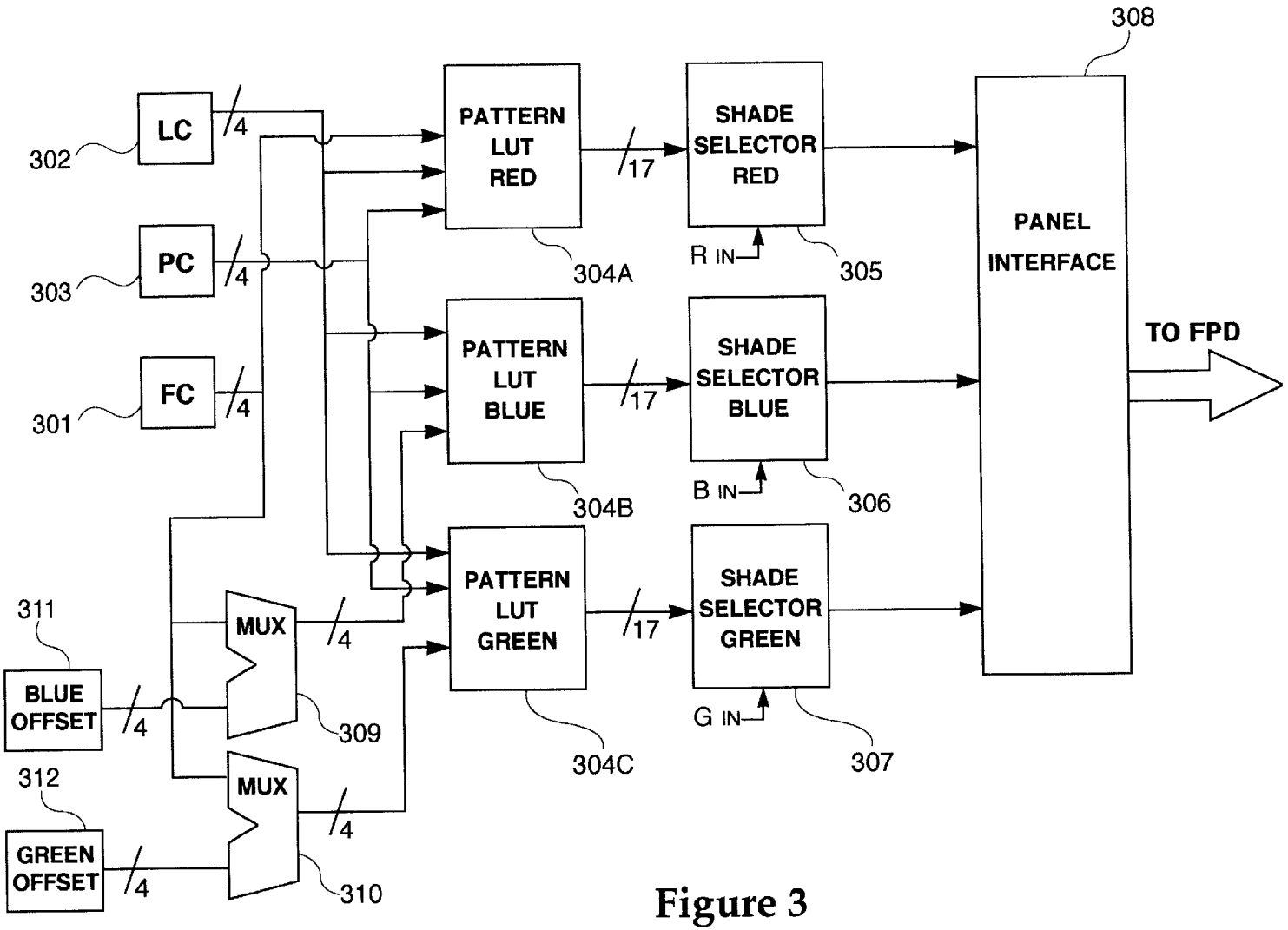
FIG. 3 is a block diagram illustrating the shading circuitry of the present invention for a flat panel display controller.
Figures 4A, 4B, 4C, 4D:
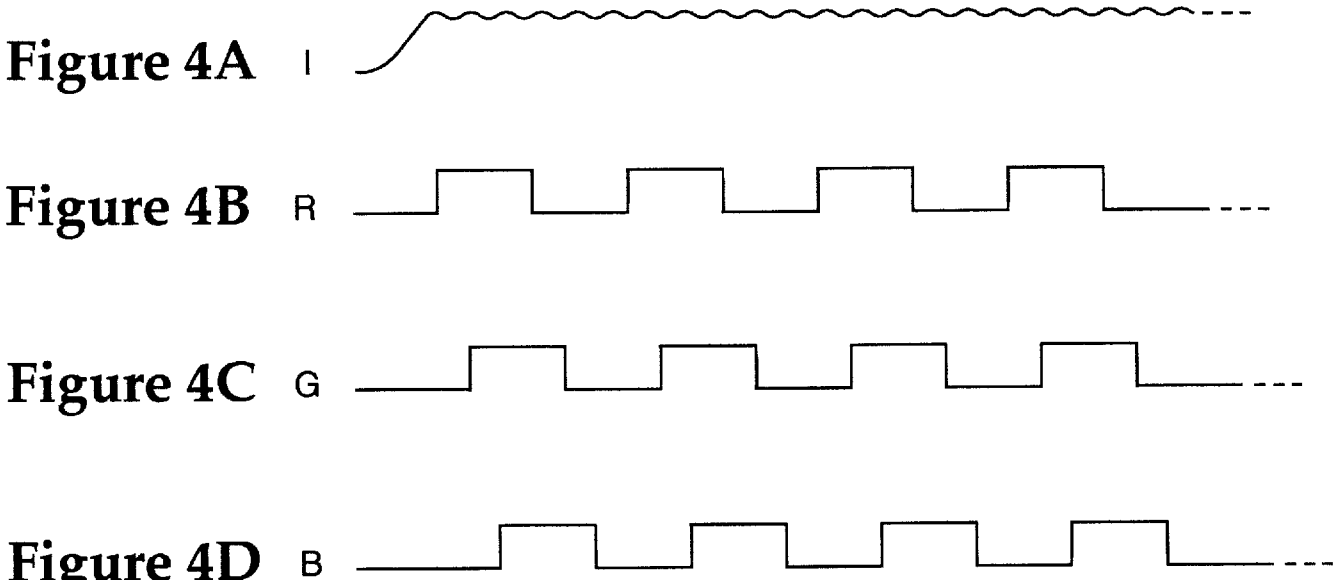
FIG. 4A is a waveform diagram illustrating current to the three sub-pixel shading devices in the present invention.
FIG. 4B is a waveform diagram illustrating duty cycles for red sub-pixels in the present invention.
FIG. 4C is a waveform diagram illustrating duty cycles for green sub-pixels in the present invention.
FIG. 4D is a waveform diagram illustrating duty cycles for blue sub-pixels in the present invention.

FIG. 3 is a block diagram illustrating the shading circuitry of the present invention for a flat panel display controller. In the apparatus of FIG. 3, different offset values may be utilized for two of the three sub-pixels to drive separate pattern look up tables 304B and 304C in a different phase, as illustrated in FIG. 4B–4D.

Figure 1:
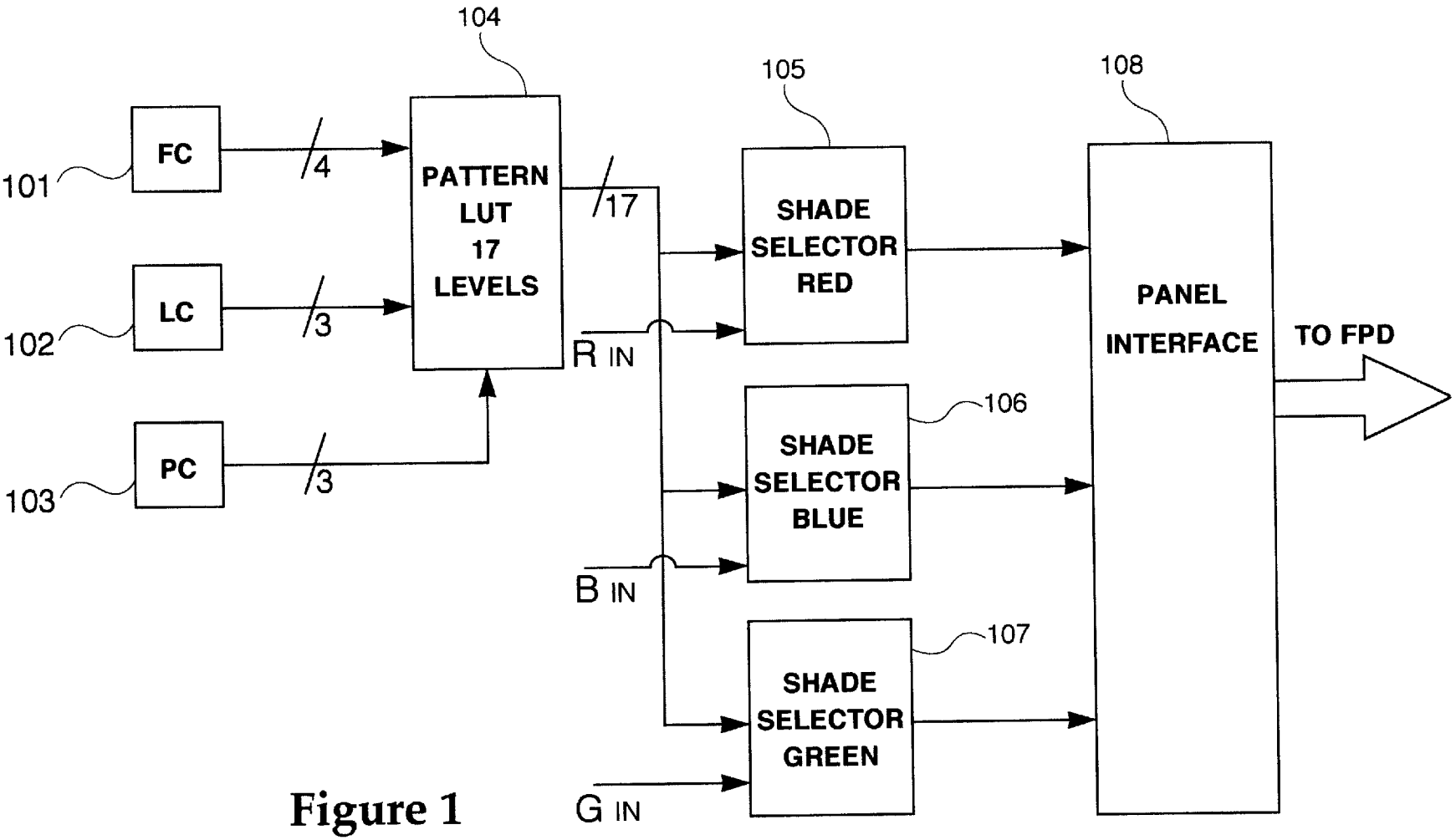
Figure 1 (Prior Art)
FIG. 1 is a block diagram illustrating prior art shading circuitry in a flat panel display controller.
Figures 2A, 2B, 2C, 2D:
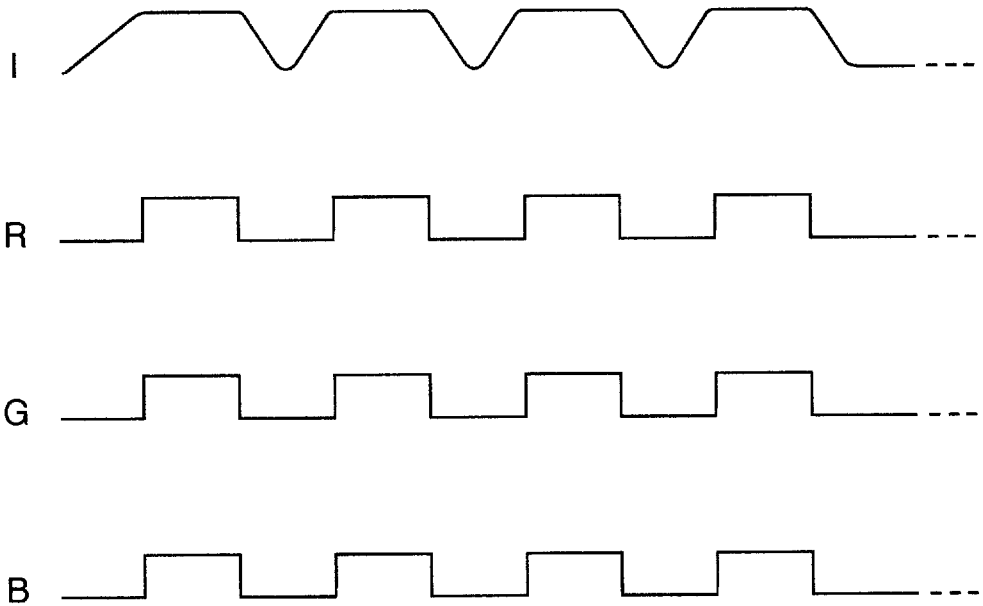
Figure 2A (Prior Art)
Figure 2B (Prior Art)
Figure 2C (Prior Art)
Figure 2D (Prior Art)
FIG. 2A is a waveform diagram illustrating current to the three sub-pixel shading devices in a the prior art.
FIG. 2B is a waveform diagram illustrating duty cycles for red sub-pixels using prior art shading techniques.
FIG. 2C is a waveform diagram illustrating duty cycles for green sub-pixels using prior art shading techniques.
FIG. 2D is a waveform diagram illustrating duty cycles for blue sub-pixels using prior art shading techniques.

Line counter 302, pixel counter 303 and frame counter 301 operate in a manner similar to their counterparts in prior art FIG. 1. However, rather than provide a single pattern LUT 104 as in FIG. 1, three separate pattern LUTs 304A, 304B and 304C may be provided, respectively, for Red, Blue and Green sub-pixels. Data from pixel counter 303 and line counter 302 may be fed to all three pattern LUTs 304A, 304B, and 304C to provide pattern address elements as in the prior art.

However, output from frame counter 301 may be fed directly only to pattern LUT 304A. The output of frame counter 301 may also be fed to adders 309 and 310 which may receive as their other inputs offset values from registers 311 and 312, respectively. Adders 309 and 310 may comprise, for example modulo N−1 adders, where N is the number of frames in a shading sequence pattern. Offset values from registers 311 and 312 may be programmed through VGA BIOS by a computer system builder at the factory, or may be altered by applications or operating system software.

Offset values loaded into registers 311 and 312 may comprise four-bit values which may be determined experimentally by trying different values for a particular flat panel display when operating different types of operating systems. In addition, it should be noted, that although two offset values are illustrated in the preferred embodiment of the present invention, significant flicker reduction may be achieved by providing an offset value for any one of the three sub-pixels (red, blue, or green).

When offset values from registers 311 and 312 are added through adders 309 and 310, the position or phase of a pattern may be offset as illustrated in FIGS. 4B–4D. FIGS 4B–4D waveform diagram illustrating duty cycles for red, blue, and green sub-pixels using the techniques of the present invention. In the example of FIGS. 4B–4D, a 50% duty cycle is illustrated, however it may be appreciated that other levels of duty cycles may be utilized within the spirit and scope of the present invention. In the preferred embodiment, up to 17 or more different duty cycles may be utilized to provide up to 17 levels of shading.

As illustrated in the example of FIGS. 4D–4D, duty cycles for blue and green sub-pixels may be offset, by one and two clock cycles, respectively, from the red sub-pixel duty cycle. As a result, overall current draw I may be reduced and current spikes reduced or eliminated. Moreover, flicker and/or strobing effects from a particular pixel may be further reduced due to the persistence of vision phenomena and the physical characteristics of the flat panel display.

While the preferred embodiment and various alternative embodiments of the invention have been disclosed and described in detail herein, it may be apparent to those skilled in the art that various changes in form and detail may be made therein without departing from the spirit and scope thereof.

For example, in place of adders 309 and 310 and registers 311 and 312, a ROM or look up table may be provided which implements such an offset effect by adding (module N−1) an offset value to an input value.

What is claimed is:

1. A shading controller for a flat panel display, comprising:

a plurality of pattern look up tables, each provided for each sub-pixel color of the flat panel display;

a line counter, coupled to each of said plurality of pattern look up tables, for generating a first portion of an address for each of said plurality of pattern look up tables;

a pixel counter, coupled to each of said plurality of pattern look up tables, for generating a second portion of an address for each of said plurality of pattern look up tables;

a frame counter, coupled to at least one of said plurality of pattern look up tables to provide a frame count as a third portion of a pattern look up table address for the at least one of the plurality of pattern look up tables;

at least one adder, coupled to said frame counter and at least another of said plurality of pattern look up tables, for adding an offset value to the frame count and providing a sum of the frame count and the offset value to at least another of said plurality of pattern look up tables as a third portion of a pattern look up table address for the at least another of said plurality of pattern look up tables.

2. The shading controller of claim 1, wherein each of said plurality of pattern look up tables outputs a plurality of data values representing a portion of a shading duty cycle for a plurality of shading values.

3. The shading controller of claim 2, further comprising a plurality of shade selectors, each corresponding to a sub-pixel color and each coupled to a corresponding one of said plurality of pattern look up tables, each of said plurality of shade selector selecting from the plurality of data values a data value corresponding to a shading duty cycle for a desired shade for a corresponding color sub-pixel.

4. The shading controller of claim 3, further comprising:

at least one offset register, coupled to a corresponding at least one adder, for storing a shading pattern frame count offset value and supplying the shading pattern frame count offset value as the offset value to a corresponding said at least one adder.

5. The shading controller of claim 4 wherein said plurality of pattern look up tables comprises three pattern look-up tables, each corresponding to one of a sub-pixel colors red, blue and green.

6. The shading controller of claim 5 wherein said at least one adder comprises two adders coupled to two of said three pattern look-up tables.

7. The shading controller of claim 6 wherein said at least one offset register comprises two offset registers each coupled to a corresponding one of said two adders, for providing corresponding offset values to each of said two adders.

8. A method for controlling shading of a flat panel display, comprising the steps of:

generating a plurality of shading pattern duty cycles each representing a shading level in each of a plurality of pattern look up tables each provided for each sub-pixel color of the flat panel display, enerating a line count as a first portion of an address for each of the plurality of pattern look up tables, generating a pixel count as a second portion of an address for each of the plurality of pattern look up tables, generating a frame count as a third portion of a pattern look up table address for at least one of the plurality of pattern look up tables, adding an offset value to the frame count and providing a sum of the frame count and the offset value to at least another of the plurality of pattern look up tables as a third portion of a pattern look up table address for the at least another of the plurality of pattern look up tables.

9. The method of claim 8, wherein each of the plurality of pattern look up tables outputs a plurality of data values representing a portion of a shading duty cycle for a plurality of shading values.

10. The method of claim 9, further comprising the step of selecting from the plurality of data values a data value corresponding to a shading duty cycle for a desired shade for a corresponding color sub-pixel.

11. The method of claim 10, further comprising the steps of:

storing a shading pattern frame count offset value, and supplying the shading pattern frame count offset value as the offset value to a corresponding at least one adder.

12. The method of claim 11 wherein the plurality of pattern look up tables comprises three pattern look-up tables, each corresponding to one of a sub-pixel colors red, blue and green.

13. The method of claim 12 wherein the at least one adder comprises two adders coupled to two of the three pattern look-up tables.

14. The method of claim 13 wherein the step of storing a shading pattern frame count offset value comprises the step of storing two offset values and said step of supplying the shading pattern frame count offset value as the offset value to a corresponding at least one adder comprises the step of supplying corresponding offset values to each of the two adders.

15. A shading controller for a flat panel display, comprising:

a plurality of pattern look up tables, each provided for each sub-pixel color of the flat panel display;

a frame counter, coupled to at least one of said plurality of pattern look up tables to provide a frame count as a portion of a pattern look up table address for the at least one of the plurality of pattern look up tables;

means, coupled to said frame counter and at least another of said plurality of pattern look up tables, for offsetting the frame count by a predetermined value and outputting the offset frame count to at least another of said plurality of pattern look up tables as a portion of a pattern look up table address for the at least another of said plurality of pattern look up tables.

16. The shading controller of claim 15, further comprising:

a line counter, coupled to each of said plurality of pattern look up tables, for generating a second portion of an address for each of said plurality of pattern look up tables.

17. The shading controller of claim 16, further comprising:

a pixel counter, coupled to each of said plurality of pattern look up tables, for generating a third portion of an address for each of said plurality of pattern look up tables.

18. The shading controller of claim 17, wherein each of said plurality of pattern look up tables outputs a plurality of data values representing a portion of a shading duty cycle for a plurality of shading values.

19. The shading controller of claim 18, further comprising a plurality of shade selectors, each corresponding to a sub-pixel color and each coupled to a corresponding one of said plurality of pattern look up tables, each of said plurality of shade selector selecting from the plurality of data values a data value corresponding to a shading duty cycle for a desired shade for a corresponding color sub-pixel.

20. The shading controller of claim 19, further comprising:

at least one offset register, coupled to a corresponding at least one adder, for storing a shading pattern frame count offset value and supplying the shading pattern frame count offset value as the offset value to a corresponding said at least one adder.

21. The shading controller of claim 20 wherein said plurality of pattern look up tables comprises three pattern look-up tables, each corresponding to one of a sub-pixel colors red, blue and green.

22. The shading controller of claim 21 wherein said at least one adder comprises two adders coupled to two of said three pattern look-up tables.

23. The shading controller of claim 22 wherein said at least one offset register comprises two offset registers each coupled to a corresponding one of said two adders, for providing corresponding offset values to each of said two adders.

* * * * *